US005235248A

United States Patent [19]

Clark et al.

[11] Patent Number: 5,235,248

[45] Date of Patent: Aug. 10, 1993

[54] METHOD AND SPLIT CAVITY OSCILLATOR/MODULATOR TO GENERATE PULSED PARTICLE BEAMS AND ELECTROMAGNETIC FIELDS

[75] Inventors: M. Collins Clark; P. Dale Coleman; Barry M. Marder, all of Albuquerque, N. Mex.

[73] Assignee: The United States of America as represented by the United States Department of Energy, Washington, D.C.

[21] Appl. No.: 540,828

[22] Filed: Jun. 8, 1990

[51] Int. Cl.[5] ..... H01J 25/02

[52] U.S. Cl. ..... 315/5; 315/5.51; 331/79; 328/64

[58] Field of Search ..... 315/4, 5, 5.24, 5.51; 331/79, 81; 328/64

[56] References Cited

U.S. PATENT DOCUMENTS

| | | | |
|---|---|---|---|
| 2,278,210 | 3/1942 | Morton | 331/81 X |
| 2,409,224 | 10/1946 | Samuel | 315/5.51 X |
| 2,602,146 | 7/1952 | Lüdi | 315/5.51 X |
| 4,453,108 | 6/1984 | Freeman, Jr. | 315/4 X |
| 4,631,447 | 12/1986 | Friedman et al. | 315/4 X |
| 4,733,133 | 3/1988 | Dandl | 315/111.41 |
| 4,751,429 | 6/1988 | Minich | 315/5 |

OTHER PUBLICATIONS

Krall, J. and Lau, Y. Y.; "Modulation of an intense beam by an external microwave source: Theory and Simulation"; Appl. Phys Lett; vol. 52, No. 6; Feb. 8, 1988; pp. 431–433.

*Primary Examiner*—Robert J. Pascal
*Assistant Examiner*—Benny T. Lee
*Attorney, Agent, or Firm*—Karla Ojanen; James H. Chafin; William R. Moser

[57] ABSTRACT

A compact device called the split cavity modulator whose self-generated oscillating electromagnetic field converts a steady particle beam into a modulated particle beam. The particle beam experiences both signs of the oscillating electric field during the transit through the split cavity modulator. The modulated particle beam can then be used to generate microwaves at that frequency and through the use of extractors, high efficiency extraction of microwave power is enabled. The modulated beam and the microwave frequency can be varied by the placement of resistive wires at nodes of oscillation within the cavity. The short beam travel length through the cavity permit higher currents because both space charge and pinching limitations are reduced. The need for an applied magnetic field to control the beam has been eliminated.

11 Claims, 6 Drawing Sheets

METHOD AND SPLIT CAVITY OSCILLATOR/MODULATOR TO GENERATE PULSED PARTICLE BEAMS AND ELECTROMAGNETIC FIELDS

The United States Government has rights in this invention pursuant to Contract No. DE-AC04-76DP00789 between the Department of Energy and American Telephone and Telegraph Company.

This invention relates generally to high energy particle beams and more particularly to a device whose self-generated oscillating electromagnetic field converts a steady particle beam into a modulated particle beam. The modulated beam can be used to generate microwaves.

BACKGROUND OF THE INVENTION

This invention evolves from principles underlying the transit time oscillator (TTO) concept and the klystron wherein an electron beam interacts with an oscillating electric field to amplify or generate microwaves.

In its simplest form, a transit time oscillator (TTO) is a pillbox cavity through which an axial high energy uniform electron beam passes. The pillbox cavity has natural modes of oscillation determined by its dimensions. When the transit time of the electrons in the cavity is slightly greater than a natural period of the cavity, the beam will experience both signs of the alternating electric field during transit. Under these conditions, the electron beam can give up kinetic energy to those naturally occurring cavity modes and the beam becomes unstable. This transfer of energy from the electron beam generates within the cavity an electromagnetic field oscillating at the natural frequencies of the cavity. The growth rate of the instability can be estimated by the relative amount of the exchanged energy to the total electromagnetic energy in the cavity. Growth rates of the instability are enhanced by operating near the space charge limit of the beam. Thus, transit time oscillators in which the current is near the space charge limit should exhibit rapid growth of beam instability. Eventually the instability saturates when within the cavity, the integrated electric field along the beam equals the beam energy. Once saturation occurs electrons will be stopped and even reversed because the field opposes the motion. However, during the alternating phase the electron beam passes through the cavity and is actually pushed by the alternating electric field.

A klystron takes advantage of the phenomena wherein some of the electrons are retarded and others are accelerated by externally driven oscillating cavity fields. A klystron allows this velocity modulated electron beam to drift in free space. In the drift space, the separation between beam bunches becomes larger so that distinct electron pulses are produced. Because the length of klystron tubes are typically on the order of meters, an external magnetic field is applied to keep the electron beam on axis.

As electron beams become more relativistic, the growth rates of the instability diminish because it becomes increasingly difficult to alter the beam's velocity. To overcome the restraint posed by relativistic beams, two methods have been proposed. One is to use a non-relativistic ion beam, which can achieve much higher energies. Another proposed method to reduce the constraint is to deflect the beam transversely rather than longitudinally. This is the "Transvertron" concept and is reminiscent of the beam breakup instability observed in accelerators.

The TTO remains a concept because of several constraints which have not been practicably solved. In general, for the transit time to be longer than the modal period, the pillbox cavity must have a small radius and long length. As an example, these electron beam devices typically are used in microwave generation and amplification. For microwaves with a frequency of approximately 1 GHz or, equivalently a free space wavelength of thirty centimeters, and with a 200 keV electron beam, a TTO would require a radius of 11.5 centimeters and a length of 23 centimeters in order for the beam to experience a reversing electric field during its transit time in the cavity. The distance a high current beam can travel, however, is limited both by its tendency to pinch and by its own space charge. Thus, as in a klystron, an externally applied magnetic field would be required to keep the beam from pinching but space charge limitations will still restrict the total current.

One device which overcomes the space-charge effects of prior art microwave devices is taught in U.S. Pat. No. 4,733,133, entitled "METHOD AND APPARATUS FOR PRODUCING MICROWAVE RADIATION" to Dandl. This device illustrates the increasing complexity of microwave generation devices and methods. The invention implements an electron plasma confined by an externally applied magnetic field within a small space. The method further employs a complicated arrangement of magnetic coils to shape that plasma into annular dimensions and then adiabatically compresses that plasma to generate microwaves.

A variation of the standard virtual cathode oscillator based on a radially inward cylindrical geometry which takes advantage of the space charge limit of relativistic electrons is proposed in U.S. Pat. No. 4,751,429, entitled "HIGH POWER MICROWAVE GENERATOR" to Minich. In this instance, electrons are emitted from a hollow cylindrical velvet-lined real cathode through a coaxial anide onto an inner collector electrode. A virtual cathode is formed between the anode and a cylindrical collector electrode and this virtual cathode will experience spatial and temporal oscillations which generate microwaves. Additionally, electrons reflex back and forth between the real and the virtual cathodes which also generate microwaves. Typically, virtual cathode oscillators are low efficiency devices.

It has been noted that an electron beam can be modulated by an external radio frequency source. Taking advantage of this phenomena, J. Krall and Y. Y. Lau, "Modulation of an intense beam by an external microwave source: Theory and simulation" APPL. PHYS. LETT. 52 (6), Feb. 8, 1988, pp. 431–433, have shown how an electron beam traveling in close proximity to cavities already pumped with radio frequency energy will amplify that radio frequency power with a high degree of phase and amplitude stability.

SUMMARY OF THE INVENTION

A method for producing a pulsed particle beam which can be used to generate microwave radiation has been invented which first involves introducing a directional particle beam into a split cavity wherein an instability of the beam grows and generates an oscillating electromagnetic field having a frequency determined by a harmonic frequency of the cavity. The field strength grows until it is equal to or greater than the energy of the particle beam. Then, the electric field stops and reverses the beam when the oscillating electromagnetic field opposes the direction of beam travel and pumps energy into and passes the beam through the cavity when the oscillating electric field is in the direction of beam travel; resulting in an output beam that is modulated at a harmonic frequency of the split cavity. The modulated beam is injected into an extractor wherein microwaves are generated. The microwaves are extracted rom the extractor. A method for producing the electric field is also disclosed.

The invention is also the split cavity modulator (SCM) or a split cavity oscillator in which the phenomena described above occurs. The split cavity modulator comprises two conducting screens mounted to a housing and defining a cavity between them within the housing. A third conducting screen is mounted to the housing and is positioned between the two conducting screens to partition the cavity into a first region between one of the screens and the partitioning screen, and a second region between between the other screen and the partitioning screen, with the first and second regions in communication with each other. A directional input particle beam enters the cavity through the first screen and once inside the cavity, the beam becomes unstable and generates an oscillating electromagnetic field with frequencies harmonic to a fundamental frequency of the cavity. The electromagnetic field interacts with the input beam to form an output modulated beam which passes through the second conducting screen to exit the cavity.

The split nature of the cavity relaxes the size constraints on the cavity, allowing it to be both axially narrow and radially wide. The resulting short beam travel length permits higher currents because both space charge and pinching limitations are reduced. Because of the shorter transit length of the beam within the split cavity oscillator, the need for an applied magnetic field is eliminated. The SCM is capable of operating at any range of frequencies, but has been demonstrated to operate from about 200 Mhz to 2 Ghz. Typically, the SCM operates at a frequency of approximately 1 Ghz with 5 kA electron beam and a beam energy of 200 keV for a total input power of 1 GW. The range of operating voltage is approximately 50 keV to 1 MeV with the device operating slightly below the space charge limit for the voltage and particular geometry of the device. The ability of the device to function at low voltage compared with other high power microwave devices relaxes power source requirements.

Thus, it is an object of the invention to produce high-powered microwaves over a long period of time yielding high energy output.

The configuration of the split cavity modulator has been demonstrated to operate at low voltage. The short beam travel length reduces both space charge and pinching limitations. Damage because of high power is therefore minimized. Long pulse duration is achieved by using low current density and low power density.

And, there is a further need for a simple, compact and efficient means to generate a pulsed high energy particle beam which can accommodate a demand for varying frequencies.

The placement of resistive wires at the oscillatory nodes enable a particle beam to experience both phases of an oscillating electromagnetic field with several frequencies.

It is a further object of the invention to generate an oscillating electromagnetic field which converts a steady high power particle beam into a pulsed particle beam over a short distance.

The split nature of the cavity allows the cavity to be both axially narrow and radially wide, and within that compact space the beam experiences both phases of an alternating electromagnetic field, where the interaction of the beam with the alternating field creates a pulsed beam.

It is yet another object of the invention to produce microwaves using a pulsed particle beam.

It is a feature of the invention to pass the modulated particle beam into a resonating waveguide or transmission line wherein microwaves of the same frequency as the particle beam are generated.

It is yet another object of the invention to produce microwaves without an externally applied magnetic field. The shorter transit length of the beam within the split cavity oscillator eliminates the need for the externally applied magnetic field.

It is yet another object of the invention to efficiently extract energy from a modulated particle beam.

Yet another object of the invention is to efficiently extract energy from microwaves produced by the modulated beam of the invention.

The use of extractors, either in the form of waveguides or transmission lines, directly connected to the split cavity modulator make practicable the use of the microwaves generated.

And even though there presently exist many different devices capable of producing microwaves at various power levels and efficiencies, in view of the importance and extreme variety of microwave technology, there remains a continuing need for innovative and structurally simple new devices for the production of high-powered single frequency coherent microwaves.

DESCRIPTION OF THE PREFERRED EMBODIMENT

Figure 1:
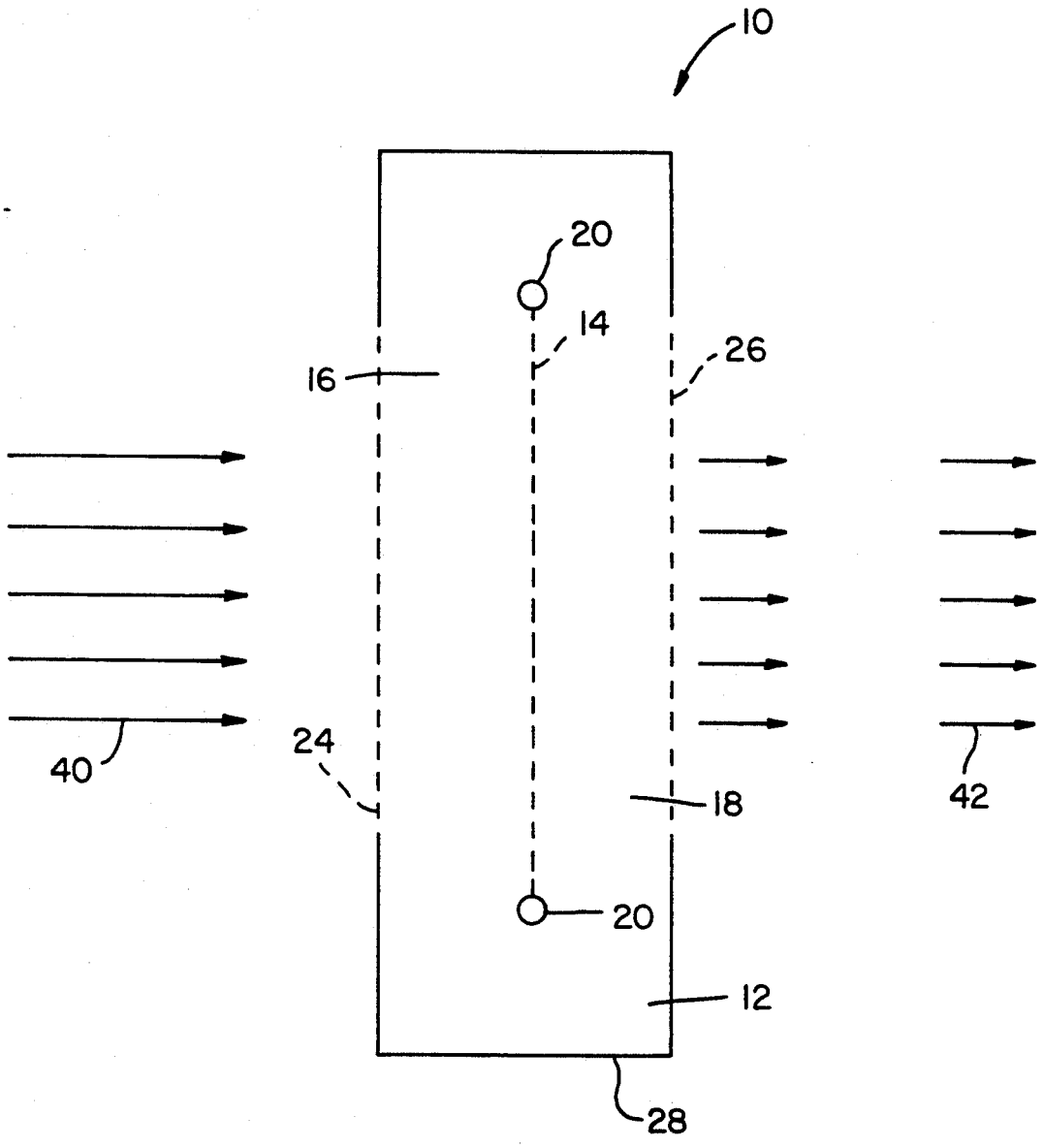
FIG. 1 is a cut-away cross section of a device comprising a split resonant cavity of the invention showing the uniform, steady injected particle beam and the modulated exit beam.
Figure 1A:
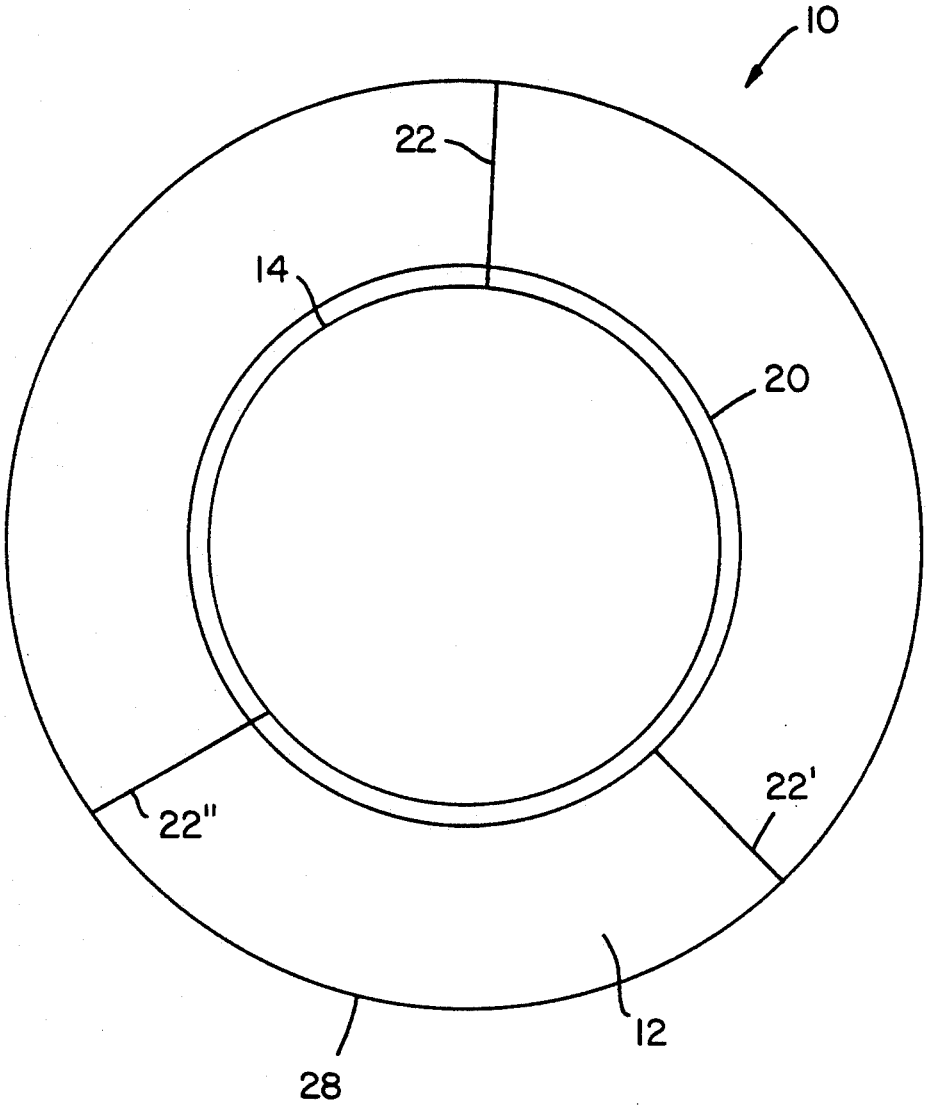
FIG. 1A is a frontal view of the split cavity modulator.

As shown in FIGS. 1 and 1A, the split cavity oscillator, which may also be referred to herein as the split cavity modulator (SCM) 10 is a resonant, high Q cavity 12 partitioned by a screen 14 to yield two cavities 16 and 18 (not shown in FIG. 1A). The screen 14 is supported by a rim 20 suspended by posts 22, 22', 22" (see FIG. 1A) connected to a housing 28. Posts 22, 22', 22" inductively isolate screen 14 from housing 28. As shown in FIG. 1, inner cavities 16 and 18 may communicate or have feedback with each other in the space between rim 20 and housing 28. The cavity entrance 24 and cavity exit 26, (see FIG. 1) like partitioning screen 14, are conductive screens, preferably of a metal mesh which are transparent to the electrons and transmit the beam but create a barrier to an electromagnetic field. Preferably, screen 14 is positioned midway between cavity entrance 24 and cavity exit 26 because this central position minimizes the amplitude of the oscillatory electric field reducing the likelihood of electrical breakdown. The cavity 12 is surrounded by housing 28, also conductive, but solid. As shown in FIG. 1, a charged particle beam 40, preferably a uniform steady electron beam, enters the SCM 10 through the first screen 24. A pulsed beam 42, resulting from the process described below, exits the SCM 10 through the exit screen 26.

Figure 2:
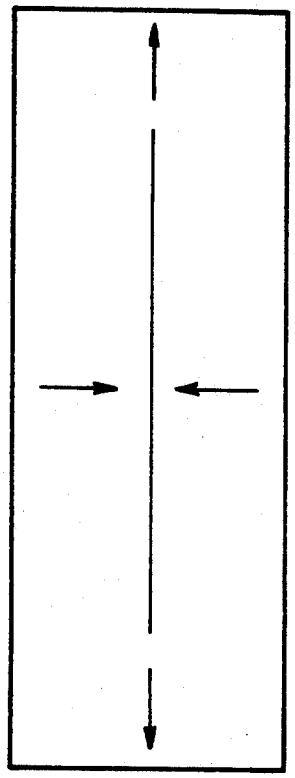
FIGS. 2, 3 and 4 are representations of the electric fields of anti-symmetric split cavity modes of the invention.
Figure 3:
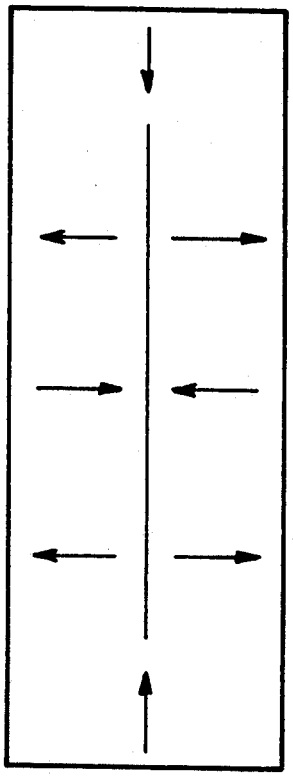
Figure 4:
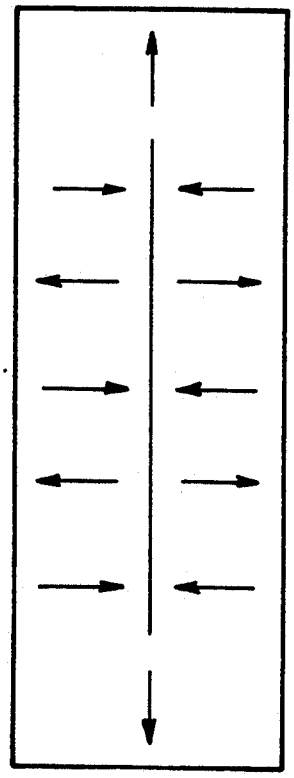

The process of the invention herein which creates a modulated or pulsed particle beam 42 is dependent upon the phenomena that, once the particle beam 40 is within a resonant cavity 12, an oscillating electromagnetic field is self-generated. In addition to the fundamental electromagnetic mode of oscillation present in the cavity 12, the SCM 10 now has an additional set of anti-symmetric resonant modes because of the presence of the partitioning screen 14. The electric fields for the first three of these additional anti-symmetric resonant modes are shown in FIGS. 2, 3 and 4, respectively. The presence of a beam 40 in the cavity 12 will lower these naturally occurring resonant frequencies, but the characteristic feature of these modes is that the electric field reverses sign across the partitioning screen 14. Returning to FIG. 1, for a SCM 10 with a radius of seven inches and with one inch gaps between the middle conducting screen 14 and the entrance and exit screens 24 and 26 respectively, and with one inch separation between the rim 20 and the housing 28, the frequencies of these naturally occurring resonant modes shown in FIGS. 2–4 are 1.1, 2.0, and 2.8 GHz, respectively.

The split cavity modulator is an inherently unstable structure; thus, any small perturbation of the beam will grow in time to a large amplitude resulting in certain effects.

The split cavity modulator is an inherently unstable structure; thus, any small perturbation of the beam will grow in time to a large amplitude resulting in certain effects. Within the split cavity modulator 10, a uniform high energy particle beam 40 becomes unstable and generates an oscillating electromagnetic field. Once the beam is within the cavity 12, the unstable beam gives up energy to the resonant electromagnetic modes of oscillation of the cavity. These modes initially grow exponentially with the growth rate increasing as the beam current approaches the space charge limit which is dependent on the distance between screens 24 and 14 and the distance between screens 14 and 26. To preclude an electrical breakdown, the distance or gap spacing between the screens 14 and 24 and the spacing between the screens 14 and 26 must exceed a certain value dependent on the electrical field strength; typically, electrical breakdown occurs when the electrical field strength exceeds 100 KV/cm. Therefore, a total gap spacing of at least one centimeter per 100 keV of beam energy is desirable.

Significantly, this configuration is unstable for transit times much shorter than a period because the opposing fields are sampled by the beam spatially, rather than temporally as when the beam remains in the cavity long enough for the field to reverse in time, as in a TTO. The beam instability transfers energy to an exponentially growing oscillating electromagnetic field until the electric field strength is equal to the energy of the beam. During one phase of oscillation, the electric field opposes the beam 40 and the beam 40 is stopped. During alternate phases of oscillation, however, the electromagnetic field is in the same direction as the beam 40 and actually pumps energy into the beam 40. The alternating retardation and acceleration of the beam 40 resulting from beam interaction with the oscillating electric field causes the particles within the beam to bunch and the beam becomes pulsed or modulated, shown as 42.

Using the SCM 10, large total current, with correspondingly high power, can be achieved while keeping the local current density low. By operating near the space charge limit, fast growth rates of the electromagnetic field are possible. Because of the short beam travel length between conducting surfaces, high currents can be used without requiring an externally applied axial magnetic field. Unlike a klystron, the SCM 10 requires no drift space to bunch a velocity modulated beam. Moreover, in contrast to other high power microwave devices, the SCM 10 can function at low voltage thereby increasing the period of time over which the device operates and relaxing the power source requirements.

Figure 5:
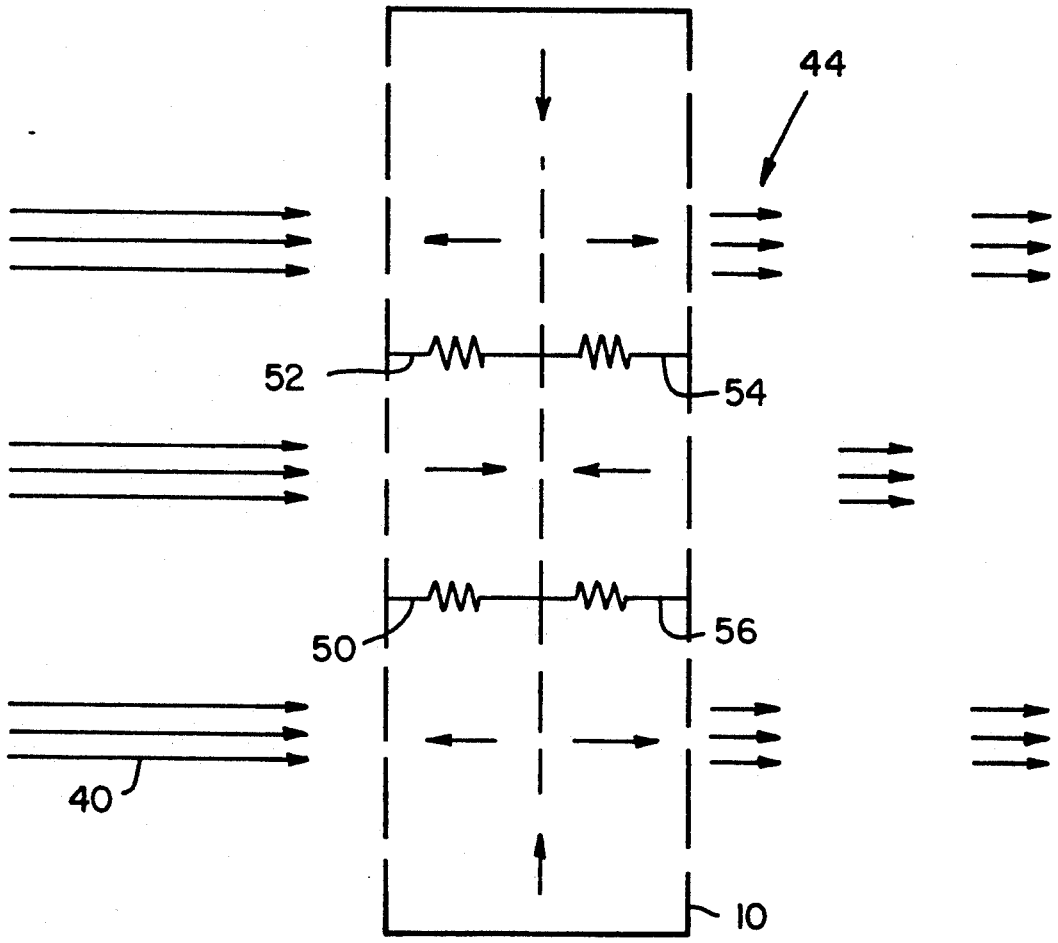
FIG. 5 is a cut-away cross section representing the higher harmonic spatial and temporal beam modulation of the invention.

Referring now to FIG. 5, the SCM 10 also offers the possibility of modulating large currents in a narrow region at the frequency of the fundamental split cavity mode or at higher frequencies. Resistive wires 50, 52, 54, 56 can be placed at certain nodes of oscillation where the field strength is zero; when the beam 40 crosses these nodes each portion of the beam 40 responds to its local electric field and the SCM 10 generates not only a spatially modulated beam as described, but alternate segments of the beam will exit one hundred eighty degrees out of phase as represented by 44. In this embodiment, the SCM 10 can function in modes other than the fundamental, permitting large structures, high frequency oscillations, and low power density.

Figure 6:
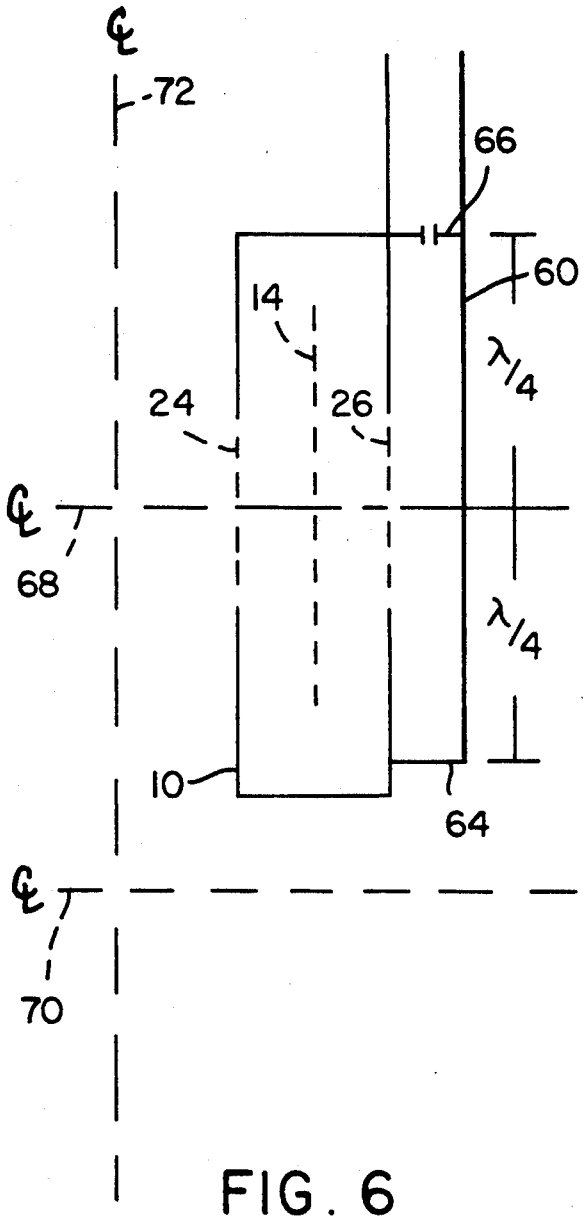
FIG. 6 represents a cut-away cross section of the invention as used in microwave generation and amplification.

FIG. 6 shows how microwave generation can be achieved using the SCM 10. A modulated exit beam (not shown) passes from the SCM 10 through a broadband extractor 60, which is either a shorted waveguide or a transmission line, at a point which is a quarter wavelength from short 64.

By placing an iris 66 at a half wavelength from short 64, the extractor 60 becomes a resonant structure. Thus, the quality factor Q of the structure increases and the electromagnetic fields within the structure can increase which may result in greater output power extraction efficiency.

Those skilled in the art will appreciate that the configuration of the SCM 10 shown in FIG. 6 can depict four different geometries. The configuration in which SCM 10 has a pillbox shape depicts a cylindrical SCM rotated about centerline 68. A horizontal centerline 70 below the SCM 10 represents an annular beam. A centerline drawn vertically 72 to the left of the figure gives a radially diverging beam, whereas a centerline drawn vertically 72 to the right of the figure gives a radially converging beam. Finally, the SCM 10 could represent a planar geometry using a modulated strip beam. The modulated beam (not shown) in FIG. 6 is retarded by the periodic electric field in the output device, giving some of its energy to the field. A beam leaving a single output extractor, such as a transmission line or a waveguide, can retain considerable modulated power.

The extraction efficiency increases when the beam is narrower because the beam encounters a smaller spatial variation in the extractor electric field. This condition favors strip or annular beams over solid ones because the low current density required for screen survival (about 20 A $cm^{-2}$) limits the input power of a solid beam.

Figure 7:
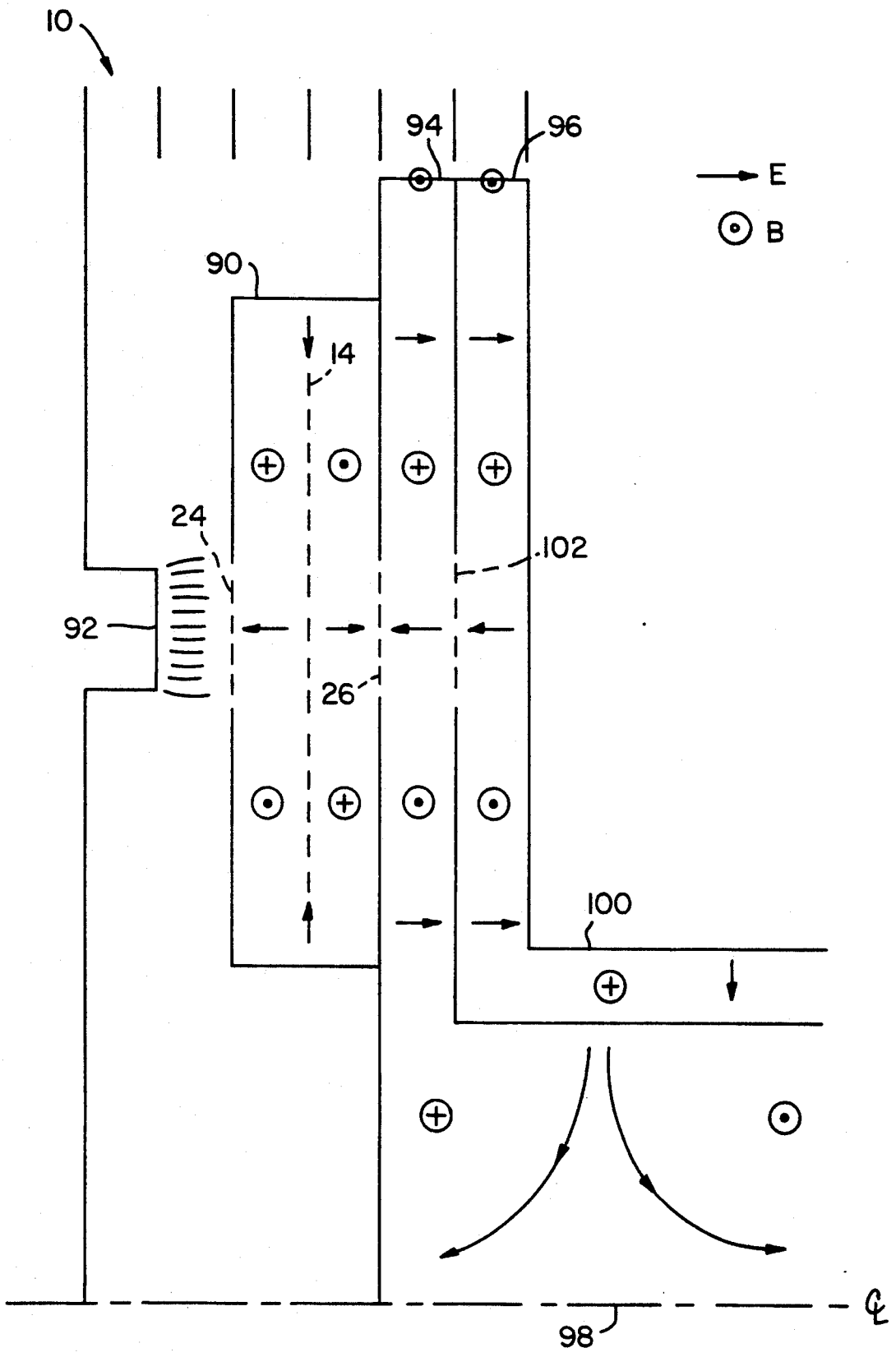
FIG. 7 represents a cut-away cross section of the preferred embodiment of the invention incorporating an annular configuration with waveguide and transmission line extractors.

FIG. 7 illustrates an embodiment of the SCM 10 used to generate electromagnetic radiation, preferably microwaves, comprising an annular SCM 90, an annular cathode emission surface 92, and two output extraction cavities 94, 96 for delivery of significant power and energy into a circular waveguide 98. Best results are achieved using a field emission cathode when the distance between cathode 92 and cavity entrance 24 is approximately the same distance as between the cavity entrance 24 and the middle screen 14. The annular configuration of the SCM 90 allows for a beam that's narrow relative to the wavelength of the oscillating electromagnetic field within the cavity 90. An additional advantage of this configuration is that it enables input of a large amount of current with a small current density because of the increased area provided by the annular geometry. The first extraction cavity 94 transitions into a circular waveguide 98 and the second extraction cavity 96 feeds into a coaxial transmission line 100. Extraction cavities 94 and 96 are driven in their fourth harmonic. Since the phase velocities in the waveguide 98 and transmission line 100 are different, the partition screen 102 between them need only extend to the physical location where the two outgoing waves are in place. The partition 102 can then be terminated, leaving a TM wave in the large circular waveguide 98. With 130 kV applied, 13.5 kA of current will be drawn. Of the 1.75 GW of injected power, 290 MW will be generated by the first cavity 94 and 220 MW by the second cavity 96. Thus, 510 MW at 1.5 GHz flows down the large waveguide 98. This is nearly thirty percent of the input power to the SCM 90. The low current density, low power density, and modest voltage favor long time operation so it would not be unreasonable to expect considerable radiation of energy from this design.

We have thus shown a completely new device and method to generate a pulsed particle beam and a self-generated oscillating electromagnetic field. Nothing in the prior art suggests or demonstrates anything resembling our invention which essentially converts a high power DC current into a high power AC current a very short distance later. The high power AC current which can then be used for the generation of microwaves.

The foregoing description of the invention has been presented for purposes of illustration and description. It is not intended to be exhaustive or to limit the invention of the precise form disclosed, and many modifications and variations are possible in light of the above teaching and use contemplated. Any of the alternate geometries of FIG. 6 could be used as a basis. The embodiment of FIG. 7 is a variation of rotating the SCM 10 about centerline 70 as shown in FIG. 6 and was chosen to best explain the principles of the invention and its practical application to thereby enable other skilled in the art to best utilize the invention. It is intended that the scope of the invention be defined by the claims appended hereto.

We claim:

1. A method of producing a modulated particle beam using a split cavity oscillator/modulator comprising the steps of:

forming a uniform particle beam having a specified beam current and possessing a space charge which is near a limiting value for the split cavity modulator but which does not exceed said limit, introducing said uniform particle beam along a direction of travel which positions said beam for entry into the split cavity modulator having electromagnetic oscillatory modes associated therewith wherein entry by said beam into the split cavity modulator generates an unstable mode for said beam thereby causing the generation of an oscillating electromagnetic field within the split cavity modulator wherein said unstable mode will cause saturation of the cavity when the electric field strength of the oscillating electromagnetic field becomes equal to the energy associated with said particle beam resulting in said beam being stopped when the oscillating electromagnetic field opposes the direction of travel of said beam, and permitting the passage of the beam out of the cavity when the oscillating electromagnetic field is in a like direction to the direction of travel of the beam, resulting in a pulsed modulation of said beam when the beam exits the cavity along the direction of travel, positioning a cavity splitting screen in a central position within the cavity to minimize amplitudes associated with said oscillating electromagnetic field to reduce the likelihood of an electrical breakdown.

2. The method of claim 1 involving placing resistive wires at select points in the cavity to connect respective nodes in the oscillatory field and thus, suppress undesirable oscillatory modes.

3. In combination, an apparatus comprising:

(a) a first conducting screen mounted to a housing, and a second conducting screen mounted to said housing, thereby defining a cavity within aid housing between said first and second screens, where a directional input particle beam enters said cavity through said first screen; and (b) a third conducting screen mounted to said housing positioned between said first and second conducting screens to partition said cavity into a first region between said first and third conducting screens, and a second region between said second and third conducting screens, with said first and second regions coupled to each other;

where within said first and second regions of said cavity, said input particle beam becomes unstable and generates an oscillating electromagnetic field having harmonics to a fundamental frequency of said cavity, and said electromagnetic field interacts with said input beam to generate an output modulated beam which passes through said second conducting screen to exit said cavity.

4. An apparatus as in claim 3 wherein said first, second, and third conducting screens are each comprised of metal.

5. An apparatus as in claim 3 further comprising said third conducting screen positioned midway between said first and second conducting screens.

6. An apparatus as in claim 3 wherein said cavity, said first and second and third conducting screens, and said housing are each annular.

7. An apparatus as in claim 3, further comprising resistive wires in said cavity mounted on and extending between said conducting screens at nodes of said oscillating electromagnetic field.

8. An apparatus as in claim 3, further comprising at least one extractor cavity coupled to said second conducting screen into which said output modulated beam passes and gives up energy to said extractor cavity thereby generating electromagnetic radiation therein.

9. An apparatus of claim 8, further comprising a transmission line connected to at least one of said extractor cavity to extract said electromagnetic radiation therefrom.

10. An apparatus as in claim 8, further comprising a waveguide connected to at least one of said extractor cavity to extract said electromagnetic radiation therefrom.

11. In combination, an apparatus comprising:

(a) an annular resonant cavity contained within a conductive annular housing having a first conducting metal screen mounted to said housing whereby an input particle beam enters said cavity through said first screen along a direction of travel, and a second conducting metal screen also mounted to said housing whereby an output modulated beam passes;

(b) a third annular conducting metal screen positioned midway between said first and said second conducting screens thereby partitioning said cavity into a first region defined by said first and third conducting screens which communicates with a second region defined by said second and third conducting screens, whereby, said input particle beam, upon entry to said cavity, loses energy to said cavity thus causing an electromagnetic field to be generated in said first and second regions of said cavity, said electromagnetic field oscillating at harmonics of a fundamental frequency of said cavity and interacting with said input particle beam to generate an output annular modulated beam which exits said cavity through said second conducting screen; and (c) a plurality of extraction cavities sequentially linked to said second conducting screen into which said output annular modulated beam enters, gives up energy, and generates electromagnetic waves therein, a first one of said extraction cavities is coupled to said second conducting screen and extending into a circular waveguide, and a second one of said extraction cavities coupled to said first extraction cavity and to said waveguide and further is coupled to a transmission line for outputting electromagnetic waves.

* * * * *